US006082023A

United States Patent [19]

Dalton

[11] Patent Number: 6,082,023

[45] Date of Patent: Jul. 4, 2000

[54] SHOE SOLE

[76] Inventor: Edward F. Dalton, 6535 SW. Chelsea Pl., Portland, Oreg. 97223

[21] Appl. No.: 09/017,995

[22] Filed: Feb. 3, 1998

[51] Int. Cl.[7] ..... A43B 13/18; A43B 13/14; A43B 13/37; A43B 21/26; A61F 5/14

[52] U.S. Cl. ..... 36/28; 36/31; 36/35 R; 36/36 A; 36/43; 36/37; 36/92; 36/103; 36/141

[58] Field of Search ..... 36/28, 29, 30 R, 36/31, 32 R, 35 R, 36 A, 36 R, 43, 42, 44, 37, 24.5, 92, 103, 141

[56] References Cited

U.S. PATENT DOCUMENTS

| | | | |
|---|---|---|---|
| 333,595 | 1/1886 | Butterfield . | |
| 2,055,574 | 9/1936 | Hartl | 36/44 |
| 2,207,437 | 7/1940 | Marks et al. | 12/142 |
| 2,502,774 | 4/1950 | Alianiello | 36/28 |
| 2,985,971 | 5/1961 | Murawski | 36/28 |
| 4,033,054 | 7/1977 | Fukuoka | 36/11.5 |
| 4,316,332 | 2/1982 | Giese et al. | 36/28 |
| 4,364,188 | 12/1982 | Turner et al. | 36/31 |
| 4,577,417 | 3/1986 | Cole | 36/29 |
| 5,025,573 | 6/1991 | Giese et al. | 36/30 |
| 5,233,767 | 8/1993 | Kramer | 36/28 |
| 5,367,791 | 11/1994 | Gross et al. | 36/31 |
| 5,375,346 | 12/1994 | Cole et al. | 36/29 |
| 5,467,536 | 11/1995 | Ramer et al. | 36/28 |
| 5,493,791 | 2/1996 | Kramer | 36/28 |
| 5,524,364 | 6/1996 | Cole et al. | 36/29 |
| 5,545,463 | 8/1996 | Schmidt et al. | 36/29 |
| 5,619,809 | 4/1997 | Sessa | 36/3 R |
| 5,664,341 | 9/1997 | Schmidt et al. | 36/28 |
| 5,678,328 | 10/1997 | Schmidt et al. | 36/29 |
| 5,771,606 | 6/1998 | Litchfield et al. | 36/29 |
| 5,775,005 | 7/1998 | McClelland | 36/31 |

FOREIGN PATENT DOCUMENTS

| | | | |
|---|---|---|---|
| 0619084 | 10/1994 | European Pat. Off. | A43B 13/18 |
| 2522482 | 9/1983 | France . | |
| 1444091 | 7/1976 | United Kingdom | 36/28 |
| 2221378 | 2/1990 | United Kingdom | 36/29 |

*Primary Examiner*—Paul T. Sewell
*Assistant Examiner*—Anthony Stashick
*Attorney, Agent, or Firm*—Sidley & Austin

[57] ABSTRACT

A shoe sole having an outer sole with a heel section and a ball section and providing buttons in the peripheral area of the ball and heel sections and pods in the interior area of the ball section. The peripheral area of the sole is stiffer than the interior portions of the sole.

13 Claims, 5 Drawing Sheets

SHOE SOLE

BACKGROUND OF THE INVENTION

Shoes have been used throughout history to protect the bottom of the feet and facilitate travel. Shoe is used in the broad sense herein to include sandals, shoes, boots and footwear in general.

Shoes have two major components: the sole on which the wearer stands and the uppers which serve to hold the sole on the foot. Basic shoe design has remained the same for many years with shoes varying only by substitution of various materials. More recently, some types of shoes have been made with specialized designs in an effort to make the shoe more suitable for particular activities such as running, walking, tennis, etc. Most of the specialized designs have been in the area of the shoe market known as sports shoes. Sports shoes have received particular attention because of the increased stress such activity places on the feet, ankles and legs of the wearer.

The primary focus in prior shoes has been to achieve a tight fit so there is little slippage of the shoe on the foot and to cushion the heel. There has been a need, however, to improve shoe design so as to improve comfort and stability of the shoe and to aid in the proper placement of the feet while walking or running. The present invention is primarily related to design of the walking shoe, but the design is also useful for running shoes and sports shoes in general. The present invention has many advantages such as ease of construction, providing support to the outer edge of the foot to help control pronation, and providing a massaging action to the foot.

BRIEF DESCRIPTION OF THE DRAWINGS

The present invention will be better understood with reference to the accompanying drawings in conjunction with a detailed description. The drawings and detailed descriptions are of a preferred embodiment of the invention and thus are not to be considered limiting.

SUMMARY OF THE INVENTION

In one aspect, the present invention is a shoe sole which has a peripheral area in the heel and ball sections which is stiffer than the portions of the heel and ball section within the peripheral area. Preferably, the peripheral area has a stiffness which is about 45% or more than the stiffness of the interior section of the sole.

In another aspect, the present invention relates to a sole having an outer sole, a mid sole section and an upper sole section. The mid sole section is attached to the top side of the outer sole, and the upper sole is attached over the mid sole. The outer sole defines a heel section and a ball section each having a peripheral area. The outer sole also defines buttons in the peripheral area of the ball section and pods on the interior of the ball section, the thickness of said buttons being 2 or more times greater than the thickness of the pods. The outer sole also defines buttons in the peripheral portion of the heel section and a heel cavity. The thickness of the heel buttons is 2 or more times greater that the thickness of the heel cavity. The stiffness of the buttons is preferably greater than the stiffness of the pods or the heel cavity, and preferably is 1.5 or greater times the stiffness of the pods or of the heel cavity. Stiffness refers to the resistance to bending.

In another aspect, the present invention is a shoe sole having an outer sole having buttons along the periphery of the heel and ball sections and pods within the ball section, with the buttons being stiffer than the pods. Connected to the outer sole is a mid sole heel section and a mid sole ball section. Adhered to the outer sole and mid sole is an upper sole.

DETAILED DESCRIPTION

Figure 1:
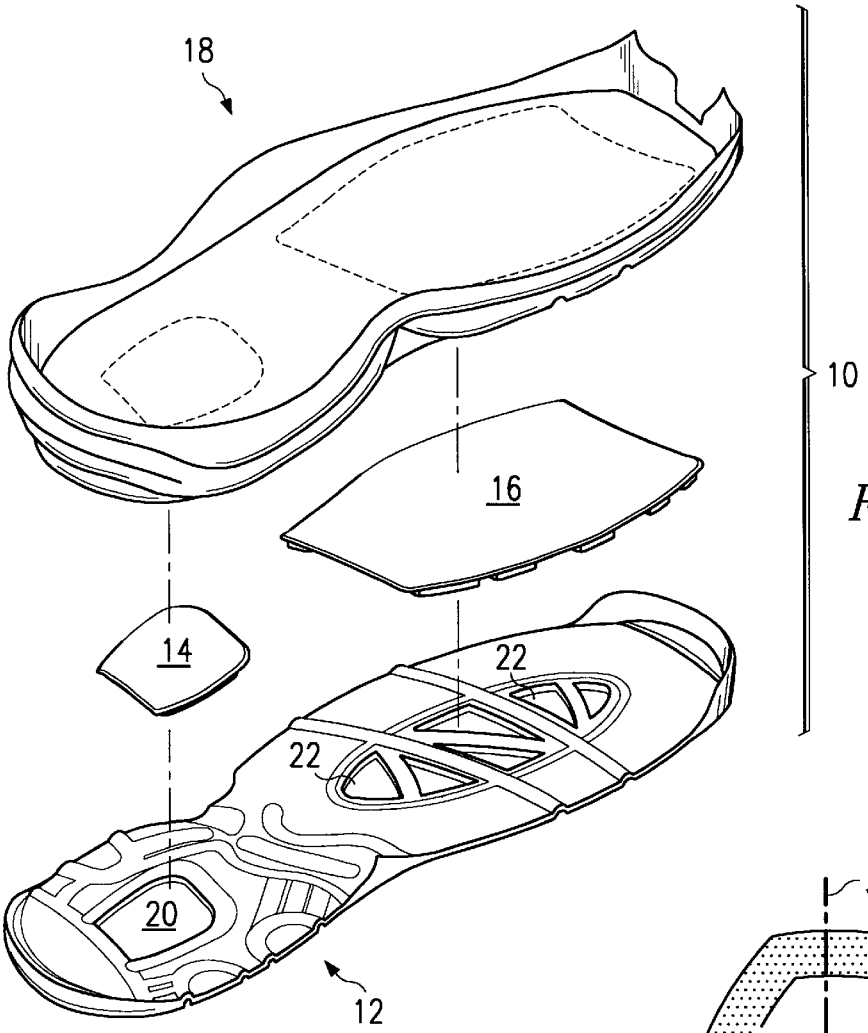
FIG. 1 is an exploded view of one embodiment of the invention.

FIG. 1 is an exploded isometric view of the sole 10 of the present invention. Sole 10 is comprised of outer sole 12 and mid sole heel section 14 and mid sole ball section 16 and upper sole 18. Mid sole sections 14 and 16 may be formed in a single piece if desired. Outer sole 12 is preferably constructed from molded rubber or other polymeric material so as to define the outline of the foot and on the upper surface in the heel portion, to define heel cavity 20 and in the ball section to define pods 22. The sole 10 is constructed by adhering together heel outer sole 12, mid sole 14 and ball mid sole 16, and upper sole 18. Like numbers in the various figures refer to like parts.

Figure 2:
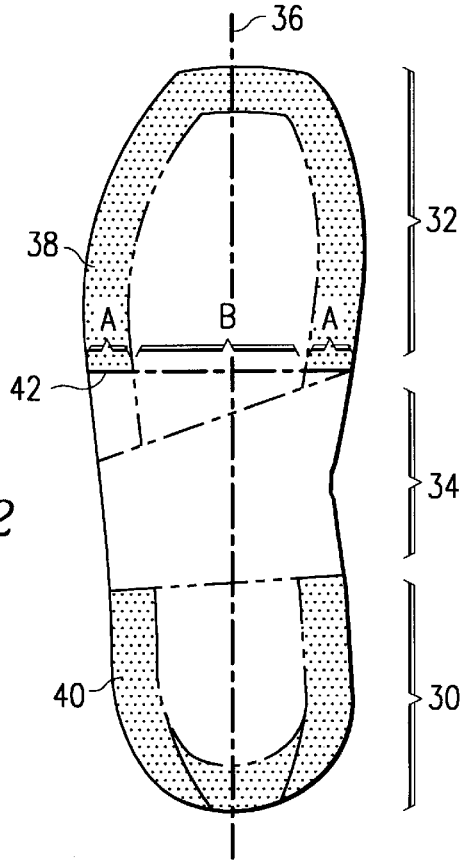
FIG. 2 is a sketch showing sections of the sole.

FIG. 2 shows the outline of a shoe sole showing heel section 30, ball section 32 and arch section 34. The sole has an axis 36 which passes through the center of the heel and through a point where the third and fourth toes would lie. The heel section has an outer peripheral area 40 shown by the shaded area in FIG. 2 which extends along the outer portion of the heel area 30. The ball portion also has an outer peripheral area 38 shown by the shaded area in FIG. 2. The term "peripheral area" in this application refers to the area extending inwardly from the outer edge of the sole a distance of about 25% of the distance measured from the edge of the outer sole on a line perpendicular to axis 36. By way of illustration, referring to FIG. 2, each section A of line 42 is about 25% of the length of line 42 and section B is about 50% of the length of line 42. The interior section or portion refers to the area inside of the peripheral area.

Figure 3A:
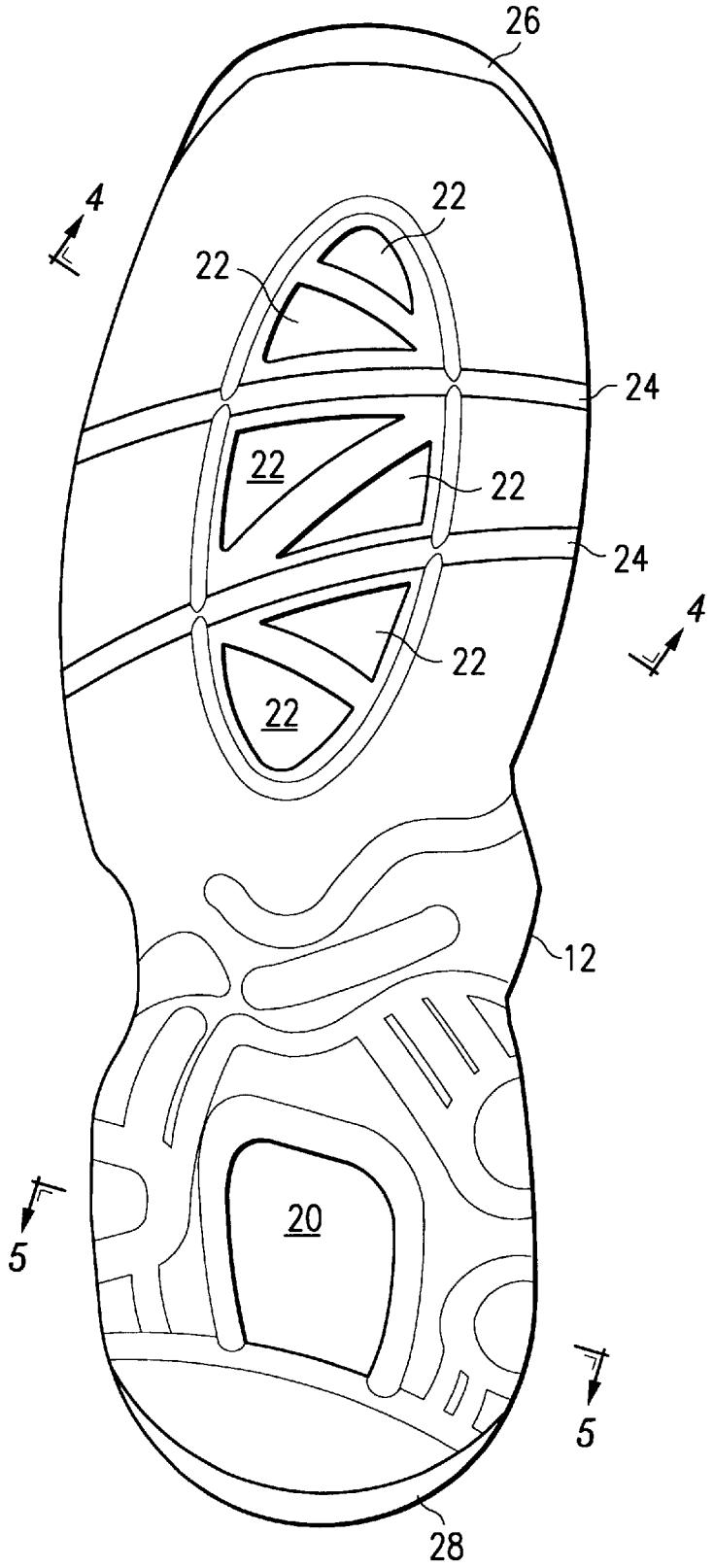
FIG. 3A is a top view of the outer sole.

FIG. 3A shows a top view of the outer sole 12. The outer sole 12 defines on its upper surface a heel cavity 20 and two or more pods 22. The pods 22 are located substantially within the interior of the ball section. It is not necessary for the pods to be of any particular shape.

In the preferred embodiment, flex lines 24 are provided at predetermined locations to increase the flexibility of the outer sole 12. An extending toe cap 26 and heel cap 28 can be provided. These caps extend the tough rubber of the outer sole 12 in front and back to resist wear on the toe and heel of the shoe.

Figure 3B:
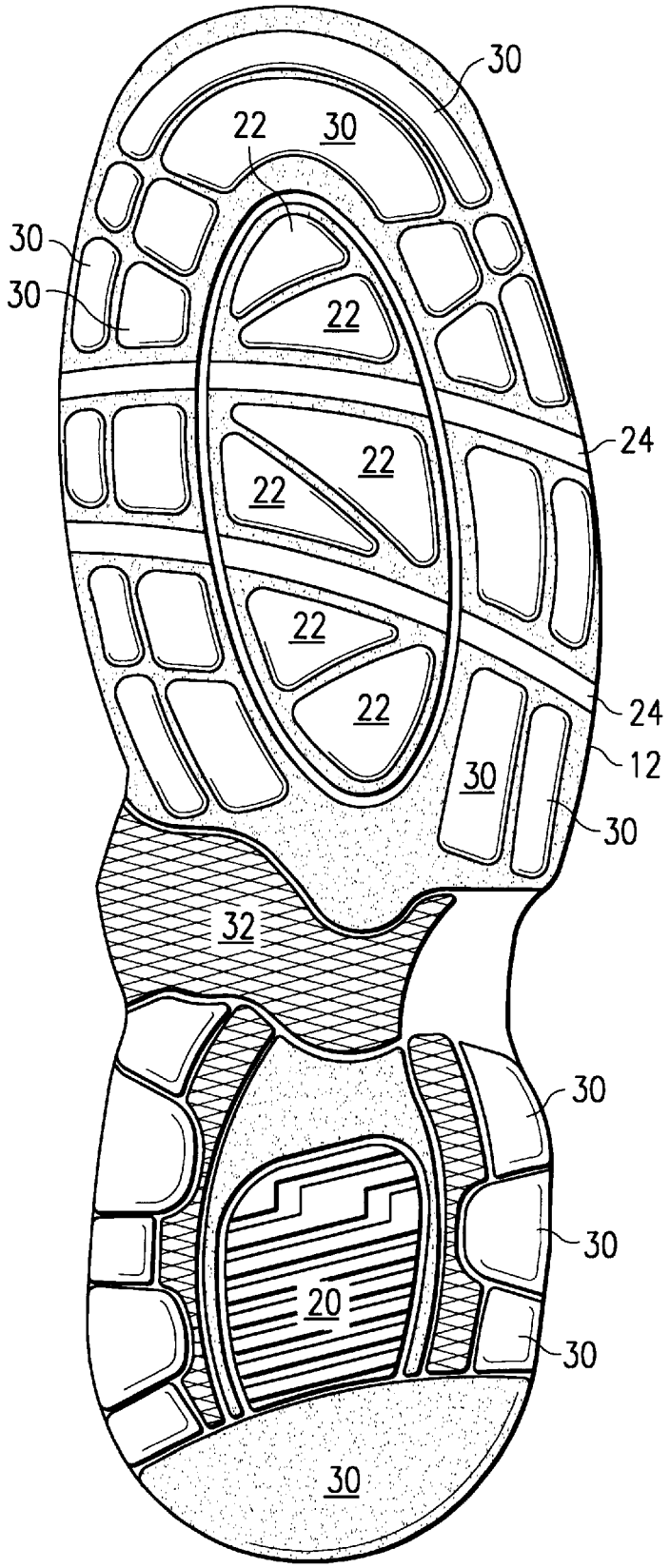
FIG. 3B is a bottom view of the outer sole.

FIG. 3B is a bottom view of the outer sole 12. A plurality of raised buttons 30 are provided on the heel and ball sections of the bottom 32 of the outer sole 12. The bottom surface of pods 22 is in approximately the same plane as the bottom surface of adjacent buttons 30.

Pods 22 are located in the ball section area inside the peripheral area of the ball section. The bottom surface of heel cavity 20 is in approximately the same plane as the bottom of the buttons 30 in the heel section 30. The bottom of the heel cavity 20 is located in the heel area inside of the peripheral area 40.

Figure 4:
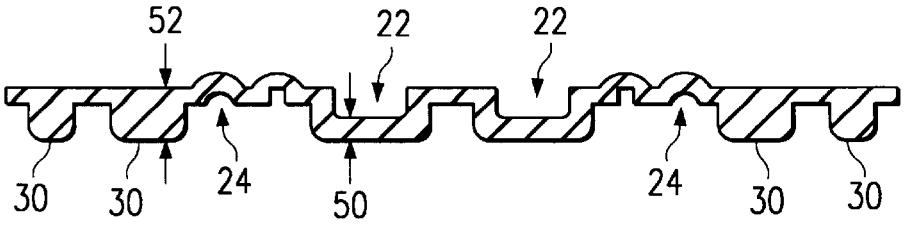
FIG. 4 is a cross-sectional view along line 4—4 of FIG. 3A.

FIG. 4 is a cross-section of the outer sole taken along line 4—4 of FIG. 3A. Outer sole body 12 defines buttons 30, flex line 24, and pods 22. As can be seen the thickness 50 of outer sole 12 at the bottom of pods 22 is less than the thickness 52 at the buttons 30. As a result, the outer sole 12 is stiffer around the peripheral area of the ball portion than inside the peripheral area (interior area). The stiffness of sole 10 is in large measure attributable to the stiffness of the various portions of the outer sole 12. The peripheral area of the outer sole is stiffer than the interior portion because the buttons are thicker than the pods or the heel cavity. The thickness of the buttons is 1.5 times or more the thickness of the pods. Preferably the thickness of the outer sole buttons in the ball section is 2 times or more the thickness of the pods. It has been found that a thickness 50 of the pods in the range of from 0.09 to 0.1 microns and a thickness 52 of the buttons in the range of from 0.19 to 0.21 microns is useful when the outer sole is made of rubber. In a preferred embodiment, the pods are about 0.0925 microns thick and the ball buttons are about 0.199 microns thick. The stiffness of the outer sole 12 at the buttons 30 is preferably at least 45% greater than the stiffness of the outer sole at the pods 22. The outer sole is molded such that peripheral buttons 30 are stiffer than pods 22. In a preferred embodiment, the thickness of the buttons in the ball section of the outer sole is 1.5 to 4 times the thickness of the pods. And in a preferred embodiment, the thickness of the buttons in the heel section is 2 to 5 times the thickness of the heel cavity.

The various layers of the sole 10 are preferably made from materials of different hardnesses also referred to as durometer. Hardness can be measured by various methods The hardness values referenced in the application are not intended to exclude equivalent hardness as measured by different techniques. In the preferred embodiment, the measured hardness for the outer sole 12 is a Shore A hardness from 63 to 67. The hardness for the mid sole sections is preferably an Asker C hardness from 27 to 33. The hardness of the upper sole is preferably an Asker C hardness from 50 to 55. These hardnesses may be measured with equipment and methods known in the art.

Figure 5:
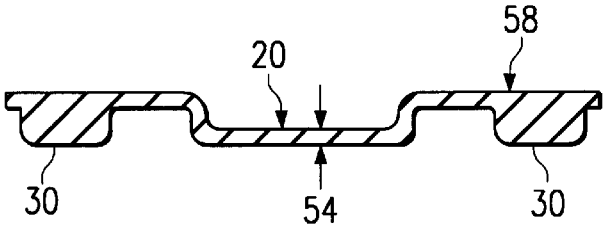
FIG. 5 is a cross-sectional view along line 5—5 of FIG. 3A.

FIG. 5 shows a cross-sectional view of outer sole 12 along line 5—5 of FIG. 3A. Heel cavity 20 has a thickness 54 which is less than the thickness 58 of buttons 30 in the heel section of the outer sole. The outer sole at the heel cavity preferably has a thickness of about 0.08 to 0.085 microns, and the buttons in the heel section have a thickness of about 0.21 to 0.23 microns. In a preferred embodiment, the thickness of the buttons in the heel section is about 0.224 microns and the thickness of the heel cavity is about 0.082 microns. The thickness of the buttons in the heel section of the outer sole is 2 times or more the thickness of the heel cavity, and preferably is 3 times or more the thickness of the heel cavity. The thickness of the buttons on the heel and the ball can be the same or may differ. Likewise, the heel cavity wall and pod wall can have the same or different thickness. The stiffness of the ball buttons may be the same or different than the stiffness of the heel buttons, and the stiffiess of the pods may be the same or different than the stiffness of the heel cavity.

Providing a stiffer peripheral area allows the edges of the foot to be supported by a stiffer, firmer sole and the interior of the foot to be cushioned by the softer interior pods. This is useful in that the design helps resist pronation and supination of the foot by providing a stiffer outer peripheral area.

Figure 6:
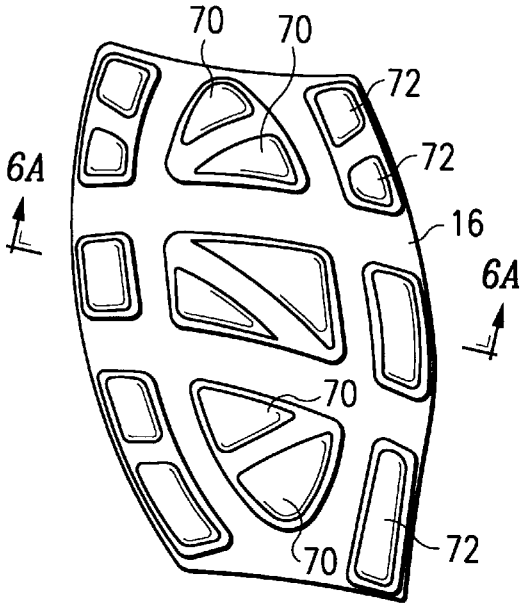
FIG. 6 is a bottom view of the ball mid sole.

FIG. 6 illustrates a bottom view of the ball mid sole section 16 sole. Extending from the bottom are pod inserts 70 which are shaped to be received by pods 22. Along the edge are button pads 72.

Figure 6A:
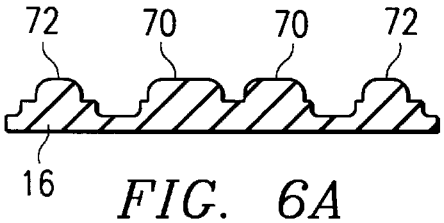
FIG. 6A is a cross-sectional view of the ball mid inner sole.

FIG. 6A is a cross-sectional view from FIG. 6 taken along line 6A—6A The shape of the mid sole is selected so that it mates with the outer sole and upper sole.

Figure 7:
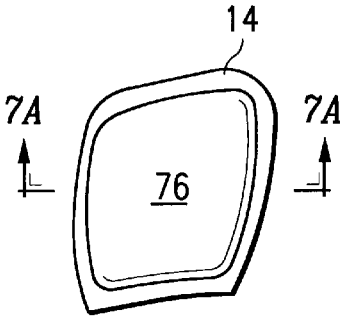
FIG. 7 is a bottom view of the heel mid sole.

FIG. 7 shows a bottom view of the heel mid sole 14 having heel insert 76 which is dimensioned to fit within heel cavity 20 of outer sole 12.

Figure 7A:
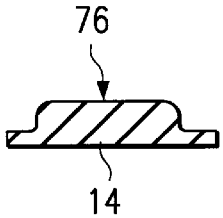
FIG. 7A is a cross-sectional view of the heel mid sole.

FIG. 7A is a cross-sectional view of FIG. 7 along line 7A—7A of FIG. 7. Heel mid sole 14 and ball mid sole 16 are preferably made from molded polyurethane. Preferably, the heel mid sole 16 is harder than the pod inserts 70 and button pads 72 of the ball mid sole 16. Preferably, the hardness of the heel mid sole 14 is 1.1 or more times that of the hardness of the pod inserts 70. The heel mid sole 14 can be stiffer than the ball mid sole because the heel mid sole is subjected to much greater force than the ball mid sole during normal walking. If desired, the ball mid sole and heel mid sole may be connected in a one-piece construction. However, to save material the two piece construction has been found useful.

Figure 8:
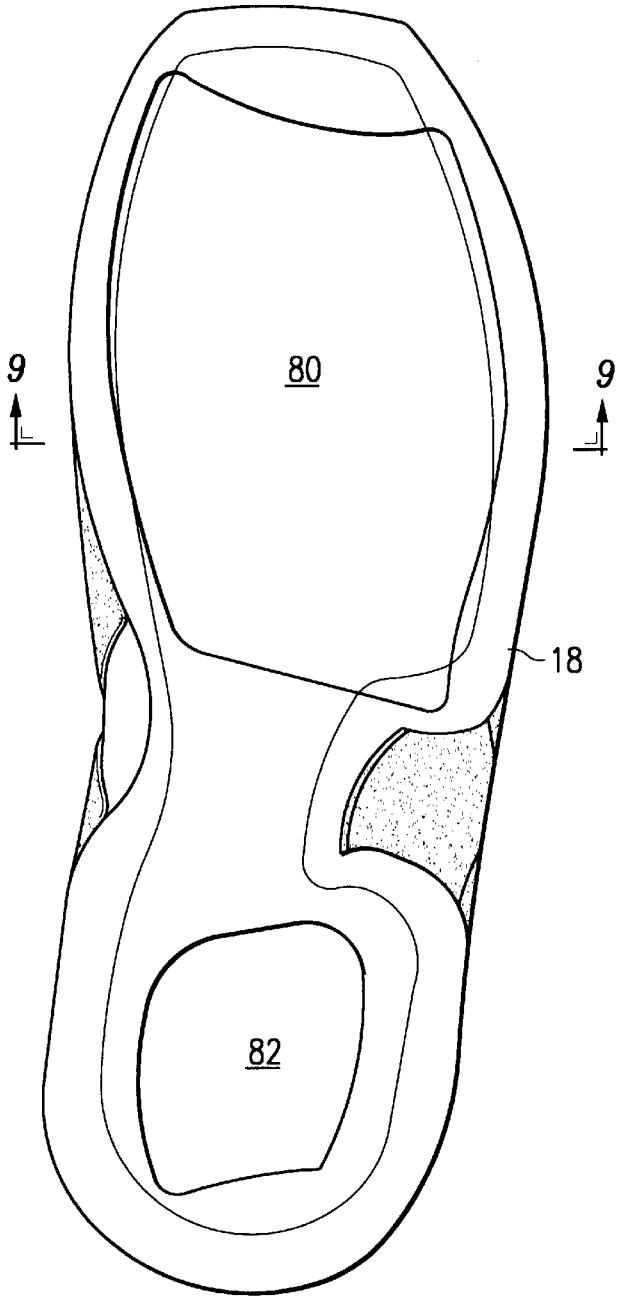
FIG. 8 is a bottom view of the upper sole.

FIG. 8 is a bottom view of the upper sole 18. The body of upper sole 18 defines on its bottom surface a first cavity 80 and a second cavity 82. The first cavity is dimensioned to receive ball mid sole 16, and the second cavity 82 is dimensioned to receive heel mid sole 14. In this way, registration of the heel mid sole and ball mid sole with the upper sole is provided.

Figure 9:
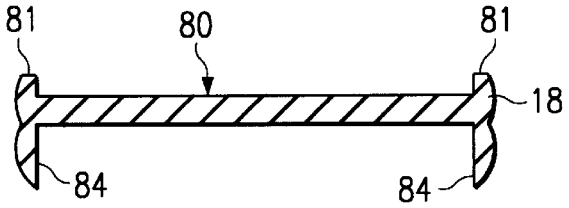
FIG. 9 is a cross-sectional view of upper sole along line 9—9 of FIG. 8.

FIG. 9 is a cross-sectional view of upper sole 18 taken along line 9—9 of FIG. 8. As can be seen, cavity 80 on each side has extending wall sections 81. On the top side of upper sole 18 (lower portion of FIG. 9 which is inverted) are extending ridges 84. These extending ridges 84 are useful in the attachment of the sole to the shoe uppers (not shown). The upper sole 18 may be made of ethyl vinyl acetate or other suitable polymeric materials known in the sports shoe industry.

The shoe of the present invention can be manufactured by molding the outer sole 12 of material such as rubber. The mid soles 14 and 16 can be molded by known techniques and are preferably molded from polyurethane. The upper sole 18 can be made from compression molded ethyl vinyl acetate. The mid soles 14 and 16 can be adhered to outer sole 12 by a suitable adhesive. Thereafter, upper sole 18 is adhered to the outer sole and the mid soles to make a completed sole. They may be attached by suitable adhesive or other methods known in the art. Thereafter, uppers are attached to the sole by methods known in the art.

In the preferred construction, the outer sole is made from composition rubber with a Shore A hardness from 62 to 67, and a specific gravity from 1.1 to 1.22. The upper sole is of compression molded ethyl vinyl acetate having an Asker C hardness between 50 to 55 and a specific gravity of 0.22 or less. The mid sole sections are of molded polyurethane with an Asker C hardness from 27 to 33 and a specific gravity of 0.25 to 0.3.

The sole of the current invention provides stiffness along the peripheral area of the heel and ball sections of the sole. Softer sections are provided on the interior portion of the sole. As a result, pronation and supination are lessened as the design of the shoe tends to prevent such rolling of the foot. Another advantage of the present invention is that different areas of different stiffness in the ball section of the foot provide a massaging action to the foot as the wearer walks. Thus, the shoe is more comfortable and walking more enjoyable.

While the present invention has been described in relation to its preferred embodiment, the description is not intended to be limiting of the invention but rather to describe the preferred embodiment. Thus, modifications to the preferred embodiment will be appreciated by those skilled in the art without departing from the invention.

What is claimed is:

1. A shoe sole comprising:

(a) an outer sole having a top and bottom and defining the shape of a sole having an outer edge and a peripheral area extending inwardly from said outer edge, with a heel section, an arch section and a ball section and defining at least one heel cavity on the top side of the heel section and a plurality of pods on the top side of the ball section located inside of the peripheral area and further defining a plurality of buttons on the bottom side of the ball section in the peripheral area, the stiffness of the outer sole in the peripheral area being at least 45% greater than the stiffness of the outer sole in the area of the pods;

(b) a heel mid sole dimensioned to be received in said cavity;

(c) a ball mid sole dimensioned to be received in said pods; and (d) an upper sole having a top and bottom, the bottom side of said upper sole being adhered to the outer sole and mid soles.

2. The sole of claim 1 wherein the thickness of said buttons of said outer sole measured in the vertical direction are 2 or more times thicker than said pods of said outer sole.

3. The sole of claim 1 wherein the outer sole is made of rubber, the mid soles of polyurethane, and the upper sole is made of ethyl vinyl acetate.

4. The sole of claim 3 wherein the specific gravity of said outer sole is from 1.1 to 1.22, the specific gravity of said mid soles is from 0.25 to 0.30, and the specific gravity of said upper sole is 0.22 or less.

5. A shoe sole comprising:

(a) an outer sole having a top and bottom and defining the shape of a sole having an outer edge and a peripheral area extending inwardly from said outer edge, with a heel section, an arch section and a ball section and defining at least one heel cavity on the top side of the heel section and a plurality of pods on the top side of the ball section located inside of the peripheral area and further defining a plurality of buttons on the bottom side of the ball section in the peripheral area; wherein the thickness of said outer sole at said buttons is from about 1.5 to 3 times the thickness of the said outer sole at said pods:

(b) a heel mid sole dimensioned to be received in said cavity;

(c) a ball mid sole dimensioned to be received in said pods;

(d) an upper sole having a top and bottom, the bottom side of said upper sole being adhered to the outer sole and mid soles; and (e) wherein the combined outer sole, mid sole, and upper sole described have an edge or outer area of said sole that is stiffer than the inner area.

6. The sole of claim 5 wherein the thickness of said buttons of said outer sole measured in the vertical direction are 3 or more times thicker than said pods of said outer sole.

7. The sole of claim 5 wherein the outer sole is made of rubber, the mid soles of polyurethane, and the upper sole is made of ethyl vinyl acetate.

8. The sole of claim 6 wherein the specific gravity of said outer sole is from 1.1 to 1.22, the specific gravity of said mid soles is from 0.25 to 0.30, and the specific gravity of said upper sole is 0.22 or less.

9. A shoe sole comprising:

(a) an outer sole having a top and bottom and defining the shape of a sole having an outer edge and peripheral area extending inwardly from said outer edge, with a heel section, an arch section and a ball section and defining at least one heel cavity on the top side of the heel section and a plurality of pods on the top side of the ball section located inside of the peripheral area and further defining a plurality of buttons on the bottom side of the ball section in the peripheral area and two or more buttons on the bottom side in the peripheral area of the heel section; wherein the material thickness of said outer sole as measured vertically at said buttons in the ball section is from about 1.5 to 3 times the material thickness of the said outer sole at said pods and the material thickness of said buttons in the heel section is from about 2 to 5 times the material thickness of said heel cavity;

(b) a heel mid sole dimensioned to be received in said cavity;

(c) a ball mid sole dimensioned to be received in said pods;

(d) an upper sole having a top and bottom, the bottom side of said upper sole being adhered to the outer sole and mid soles; and (e) wherein the combined outer sole, mid sole, and upper sole described have an edge or outer area of said sole that is stiffer than the inner area.

10. The sole of claim 8 wherein the outer sole is made of rubber, the mid soles of polyurethane, and the upper sole is made of ethyl vinyl acetate.

11. The sole of claim 9 wherein the specific gravity of said outer sole is from 1.1 to 1.22, the specific gravity of said mid soles is from 0.25 to 0.30, and the specific gravity of said upper sole is 0.22 or less.

12. A shoe sole comprising:

(a) an outer sole having a top and bottom and defining the shape of a sole having an outer edge and peripheral area extending inwardly from said outer edge, with a heel section, an arch section and a ball section and defining at least one heel cavity on the top side of the heel section and a plurality of pods on the top side of the ball section located inside of the peripheral area and further defining a plurality of buttons on the bottom side of the ball section in the peripheral area, the stiffness of the outer sole in the peripheral area greater than the stiffness of the outer sole in the area of the pods;

(b) a heel mid sole dimensioned to be received in said cavity;

(c) a ball mid sole dimensioned to be received in said pods;

(d) an upper sole having a top and bottom, the bottom side of said upper sole being adhered to the outer sole and mid soles; and (e) wherein said outer sole has a Shore A hardness of from 63 to 67, the mid soles have an Asker C hardness of from 27 to 33, and the upper sole has an Asker hardness from 50 to 55.

13. A shoe sole comprising:

(a) an outer sole having a top and bottom and defining the shape of a sole having an outer edge and a peripheral area extending inwardly from said outer edge up to about 25% of a line drawn perpendicular to an axis, passing through the center of the heel and through a point where the third and fourth toe would lie with a heel section, an arch section and a ball section and defining at least one heel cavity on the top side of the heel section and a plurality of pods on the top side of the ball section located inside of the peripheral area and further defining a plurality of buttons on the bottom side in the ball section in the peripheral area;

(b) a heel mid sole dimensioned to be received in said cavity;

(c) a ball mid sole dimensioned to be received in said pods; and (d) an upper sole having a top and bottom, the bottom side of said upper sole being adhered to the outer sole and mid soles.

* * * * *